US011112075B2

(12) United States Patent
Li et al.

(10) Patent No.: US 11,112,075 B2
(45) Date of Patent: Sep. 7, 2021

(54) INTEGRATED LAMP

(71) Applicants: OPPLE LIGHTING CO., LTD., Shanghai (CN); SUZHOU OPPLE LIGHTING CO., LTD., Suzhou (CN)

(72) Inventors: Shuangzeng Li, Shanghai (CN); Jinjing Wang, Shanghai (CN); Jing Yang, Shanghai (CN); Shitao Deng, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/908,696

(22) Filed: Jun. 22, 2020

(65) Prior Publication Data

US 2020/0318803 A1 Oct. 8, 2020

Related U.S. Application Data

(63) Continuation of application No. PCT/CN2018/123406, filed on Dec. 25, 2018.

(30) Foreign Application Priority Data

Dec. 25, 2017 (CN) ..... 201711420307.7
Dec. 25, 2017 (CN) ..... 201721835989.3

(51) Int. Cl.

| | |
|---|---|
| ***F21S 8/06*** | (2006.01) |
| ***F21S 4/28*** | (2016.01) |
| ***F21V 17/12*** | (2006.01) |
| ***F21V 23/06*** | (2006.01) |

(52) U.S. Cl.
CPC ..... *F21S 8/063* (2013.01); *F21S 4/28* (2016.01); *F21V 17/12* (2013.01); *F21V 23/06* (2013.01)

(58) Field of Classification Search
CPC ... F21S 8/063; F21S 8/065; F21S 4/28; F21V 17/12; F21V 23/06
See application file for complete search history.

(56) References Cited

U.S. PATENT DOCUMENTS

| | | | | |
|---|---|---|---|---|
| D671,670 | S * | 11/2012 | Sonneman | D26/90 |
| 10,738,976 | B1 * | 8/2020 | Chen | F21V 5/04 |
| 2002/0024812 | A1 * | 2/2002 | Agro | F21V 21/35 362/287 |

(Continued)

FOREIGN PATENT DOCUMENTS

| | | |
|---|---|---|
| CN | 202266975 U | 6/2012 |
| CN | 203036398 U | 7/2013 |

(Continued)

OTHER PUBLICATIONS

International Search Report of PCT Application No. PCT/CN2018/123406 dated Mar. 26, 2019, (6p).

*Primary Examiner* — Leah Simone MacChiarolo
(74) *Attorney, Agent, or Firm* — Arch & Lake LLP

(57) ABSTRACT

An integrated lamp and a method of manufacturing an integrated lamp. The integrated lamp includes a main lighting lamp body and auxiliary lighting lamp bodies that can be assembled to the main lighting lamp body in a plug-in way. The auxiliary lighting lamp bodies can be rotatably adjusted relative to the main lighting lamp body.

18 Claims, 4 Drawing Sheets

(56) References Cited

U.S. PATENT DOCUMENTS

| | | | | |
|---|---|---|---|---|
| 2005/0024883 | A1* | 2/2005 | Wu | H02G 3/20 362/430 |
| 2006/0044841 | A1* | 3/2006 | Harwood | F21V 23/06 362/647 |
| 2009/0135602 | A1* | 5/2009 | Liu | F21V 21/30 362/275 |
| 2011/0211338 | A1 | 9/2011 | Schulzman | |
| 2015/0198311 | A1* | 7/2015 | O'Brien | F21S 8/046 362/220 |
| 2017/0198892 | A1* | 7/2017 | Sonneman | F21S 8/063 |
| 2017/0370537 | A1* | 12/2017 | Wu | F21V 17/02 |
| 2018/0259169 | A1* | 9/2018 | DuVernet | F21S 8/063 |
| 2018/0313503 | A1* | 11/2018 | Sonneman | F21S 8/063 |
| 2019/0162369 | A1* | 5/2019 | Sonneman | F21S 2/00 |

FOREIGN PATENT DOCUMENTS

| | | | |
|---|---|---|---|
| CN | 204345422 | U | 5/2015 |
| CN | 104930414 | A | 9/2015 |
| CN | 205480470 | U | 8/2016 |
| CN | 107940354 | A | 4/2018 |
| CN | 207635180 | U | 7/2018 |

* cited by examiner

INTEGRATED LAMP

CROSS-REFERENCE TO RELATED APPLICATIONS

This application is based upon and claims the priority of PCT patent application No. PCT/CN2018/123406 filed on Dec. 25, 2018 which claims priority to the Chinese patent application No. 201711420307.7 filed on Dec. 25, 2017 and the Chinese patent application No. 201721835989.3 filed on Dec. 25, 2017, the entire content of all of which is hereby incorporated by reference herein for all purposes.

TECHNICAL FIELD

The present disclosure relates to a lighting device, particularly to an integrated lamp.

BACKGROUND

With the development of lighting technology and the improvement of people's life quality, people's demands for usage functions and application requirements of lighting devices are continuously increased. The lamp products in the market may include ceiling lamps, panel lamps and hanging lamps, especially elongated strip-shaped hanging lamps.

SUMMARY

The present disclosure provides an integrated lamp and a method of manufacturing an integrated lamp.

According to one aspect, an integrated lamp is provided. The integrated lamp may include a main lighting lamp body, and a first auxiliary lighting lamp body which is connected with the main lighting lamp body so as to be assembled on the main lighting lamp body in a plug-in way, and where the first auxiliary lighting lamp body is rotatable relative to the main lighting lamp body so as to be adjusted relative to the main lighting lamp body.

According to another aspect, a method of manufacturing an integrated lamp is provided. The method may include providing a main lighting lamp body, and connecting a first auxiliary lighting lamp body of the main lighting lamp body with the main lighting lamp body such that the first auxiliary lighting lamp body is assembled on the main lighting lamp body in a plug-in way, and where the first auxiliary lighting lamp body is rotatable relative to the main lighting lamp body so as to be adjusted relative to the main lighting lamp body.

It is to be understood that both the foregoing general description and the following detailed description are exemplary and explanatory only and are not restrictive of the present disclosure.

DETAILED DESCRIPTION

The integrated lamp provided by the present disclosure is described below in further details with reference to the drawings and examples.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The hanging lamp may adopt a structure of suspension wire, which may lead to poor balancing effect. Moreover, the hanging lamp is generally designed to have a single light-emitting surface without a fixed-point lighting structure. However, in the optical design of house decoration, it is generally expected to add a fixed point to strengthen the lighting for some special parts of the wall, such as photos and hanging paintings. One method is to install another guide rail for spotlight, but the installation of the guide rail requires additional wiring, and installation, disassembly, and replacement of the guide rail are very troublesome.

Figure 1:
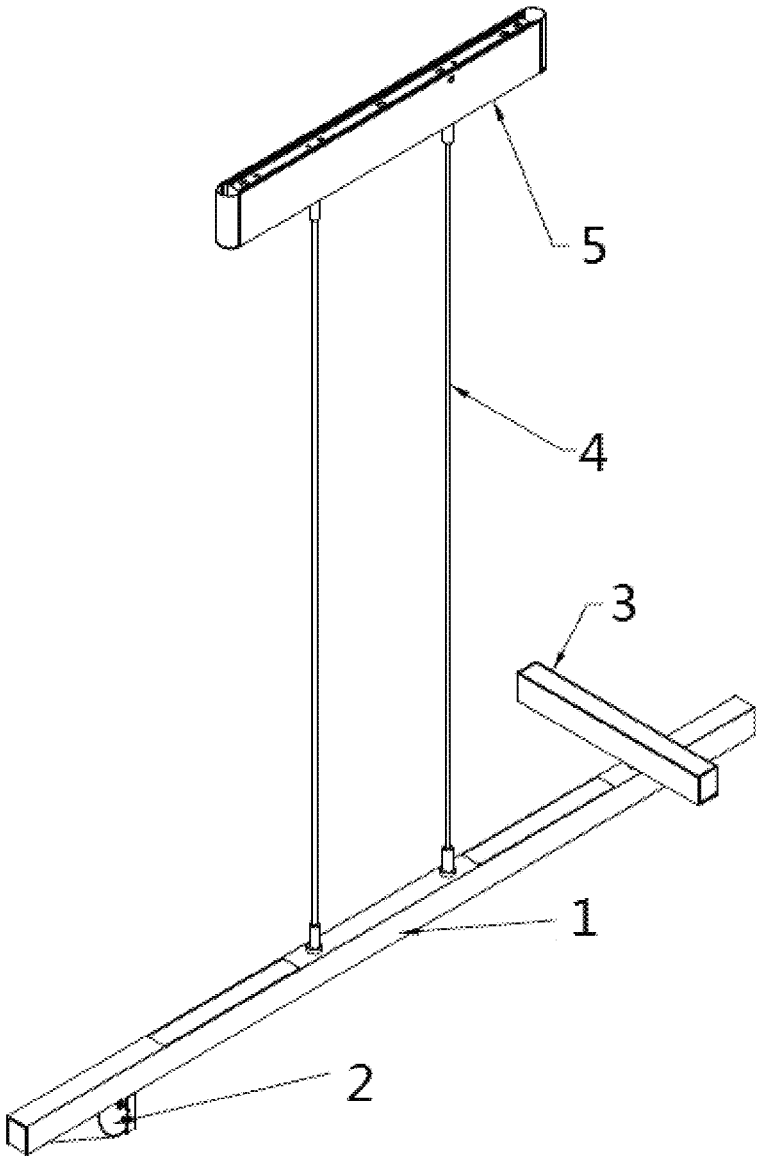
FIG. 1 is a schematic structural diagram of an example of the present disclosure.

As shown in FIG. 1, a structure of an example provided by the present disclosure includes a main lighting lamp body 1, a first auxiliary lighting lamp body 2, a second auxiliary lighting lamp body 3, a suspension connecting portion 4 and a ceiling box 5.

In this example, the main lighting lamp body 1 is an elongate-shaped hanging lamp made of aluminum, and a lower side thereof is a main light-emitting surface. In other examples, the main lighting lamp body may have a different shape. Depending on the lamp, the main lighting lamp body may also be provided with a light-emitting surface at an upper side, or at both sides thereof, without limited in the present disclosure. The main lighting lamp body 1 is connected to the ceiling box 5 through the suspension connecting portion 4, the ceiling box 5 is fixedly mounted on an mounting surface (generally a roof), and a driving power supply (not shown) can be received in the ceiling box 5. The suspension connecting portion 4 is not only a mechanical connecting portion with the two ends thereof connected to the main lighting lamp body 1 and the ceiling box 5 respectively, but also an electrical connector with a wire therein to realize power supply from the driving power supply to the main lighting lamp body 1. The suspension connecting portion 4 is a suspension rod in this example, and may be a suspension wire in other examples. In addition, in other examples, the main lighting lamp body 1 may be directly mounted on the mounting surface, and the driving power supply may also be provided inside the main lighting lamp body 1, without limited in the present disclosure.

In this example, the first auxiliary lighting lamp body 2 is a cylindrical spotlight, and an angle thereof can be adjusted in an up-down direction. The second auxiliary lighting lamp body 3 is a strip-shaped spotlight, and light sources (not shown) are provided at both ends of the strip-shaped lamp body. Due to the different structures and functions of the two auxiliary lighting lamp bodies, in this example, the first auxiliary lighting lamp body 2 and the second auxiliary lighting lamp body 3 are provided at an upper side and a lower side of the main lighting lamp body 1, respectively, so that mutual interference between auxiliary lighting lamp bodies can be avoided. The first auxiliary lighting lamp body 2 and the second auxiliary lighting lamp body 3 are electrically and mechanically connected to the main lighting lamp body 1 through plug-in type DC connecting assemblies, respectively. After the connection is completed, the main lighting lamp body 1 supplies power to the first auxiliary lighting lamp body 2 and the second auxiliary lighting lamp body 3 through the DC connecting assemblies, respectively. The DC connecting assembly includes two portions that are a male connector and a female connector. The male connector and the female connector can be rotated relative to each other upon being connected in a plug-in way, so that the first auxiliary lighting lamp body 2 and the second auxiliary lighting lamp body 3 can be rotated relative to the main lighting lamp body 1 so as to be adjusted relative to the main lighting lamp body 1.

Figure 2:
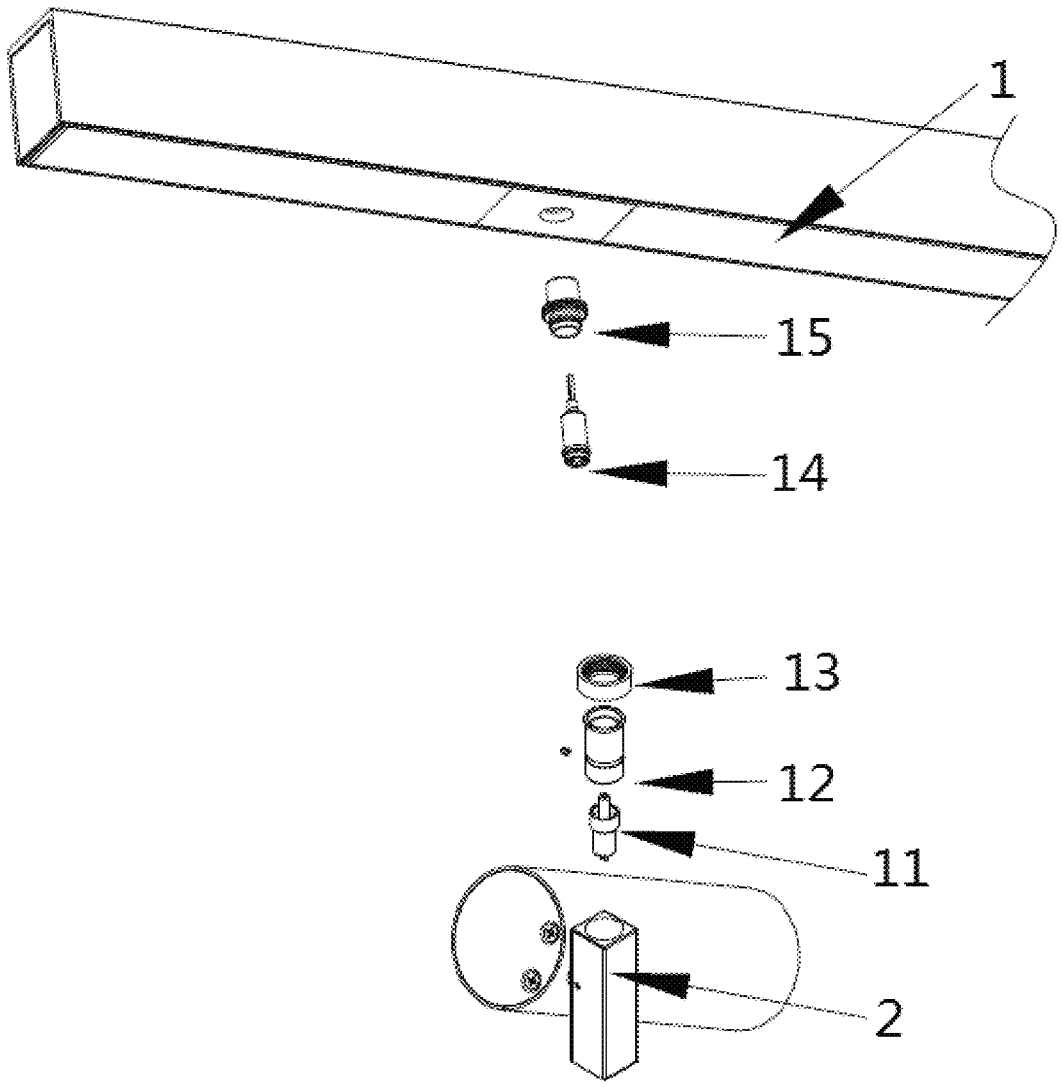
FIG. 2 is an exploded view of a connection structure between a main lighting lamp body and a first auxiliary lighting lamp body in the example of FIG. 1.
Figure 3:
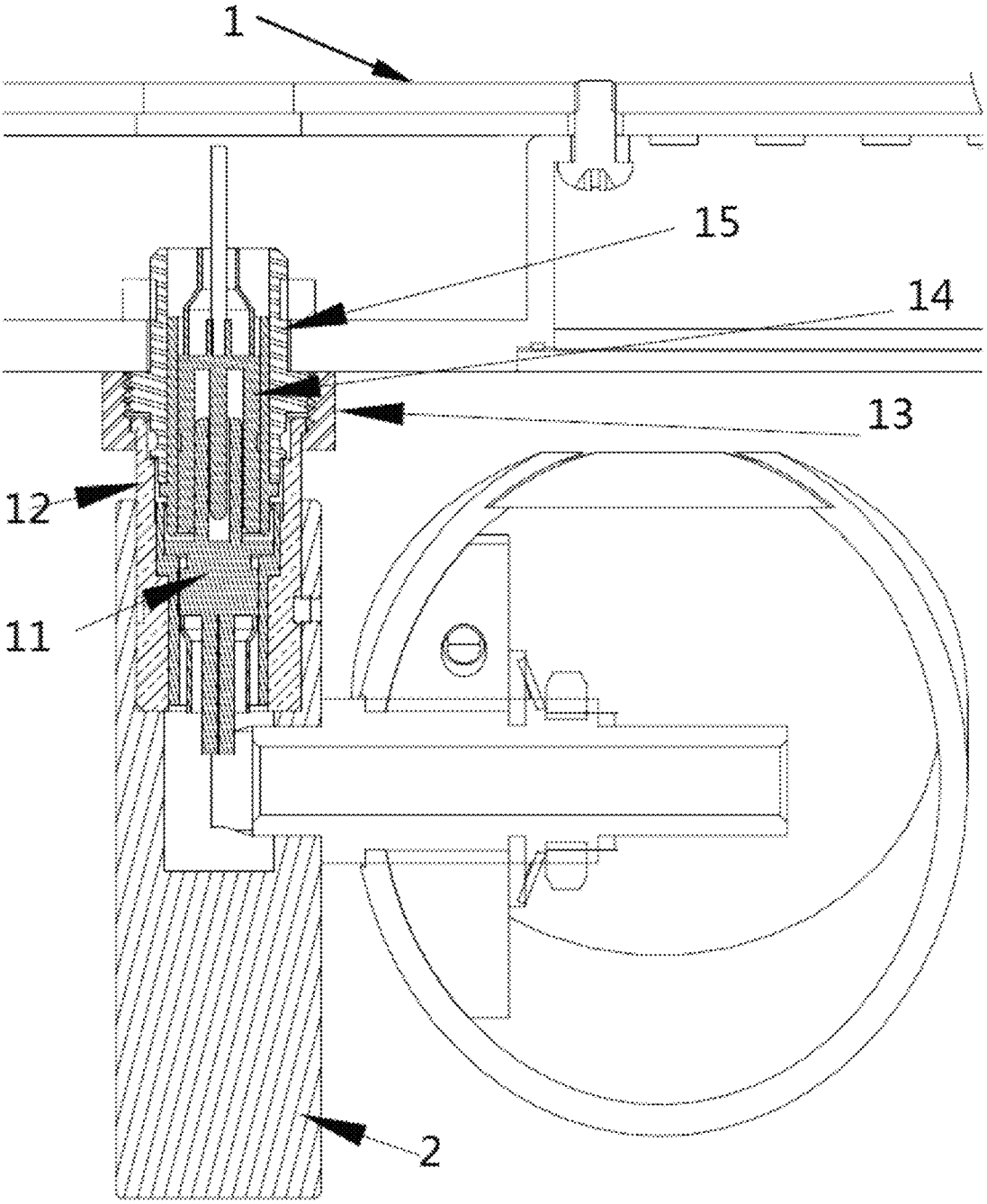
FIG. 3 is a cross-sectional view of the connection structure between the main lighting lamp body and the first auxiliary lighting lamp body in the example of FIG. 1.

The specific structure of the DC connecting assembly can refer to FIGS. 2 and 3, which show exploded views of the connection structure between the main lighting lamp body 1 and the first auxiliary lighting lamp body 2 in this example. In the figures, the female connector of the DC connecting assembly is disposed at the main lighting lamp body 1, and the male connector is disposed at the first auxiliary lighting lamp body 2. In other examples, the male connector may also be disposed at the main lighting lamp body 1, and the female connector is disposed at the first auxiliary lighting lamp body 2, without limited in the present disclosure. As shown in the figures, the female connector includes a DC female terminal 14 and a stud 15. The stud 15 has a hollowed structure and is sleeved over an external side of the DC female terminal 14. The male connector includes a DC male terminal 11, a male connector housing 12, and an anti-off nut 13. The DC male terminal 11 is disposed in the male connector housing 12, and the anti-off nut 13 is sleeved over an external side of the male connector housing. The plug-in type connection structure of the DC female terminal 14 and the DC male terminal 11 is a rotatable, plug-in type connection structure, thus when the first auxiliary lighting lamp body 2 needs to have an angle adjustment, the angle adjustment would not be restricted due to the electrical connection structure and can be adjusted at will. The stud 15 is engaged with the anti-off nut 13 in a screw-threaded way. After the DC female terminal 14 and the DC male terminal 11 are connected to each other in a plug-in way to achieve electrical connection, the anti-off nut 13 can be screwed onto the stud 15 to achieve mechanical connection. In the present disclosure, an anti-off nut is added to the housing of the DC plug-in connector, so that a mechanical connection between the spotlight used as the first auxiliary lighting lamp body 2 and the main lighting lamp body 1 is achieved, which can prevent the spotlight from dropping down during usage by the user, thereby enhancing product safety. The DC connecting assembly between the second auxiliary lighting lamp body 3 and the main lighting lamp body 1 adopts the same structural design as described above, without particularly repeated herein.

Figure 4:
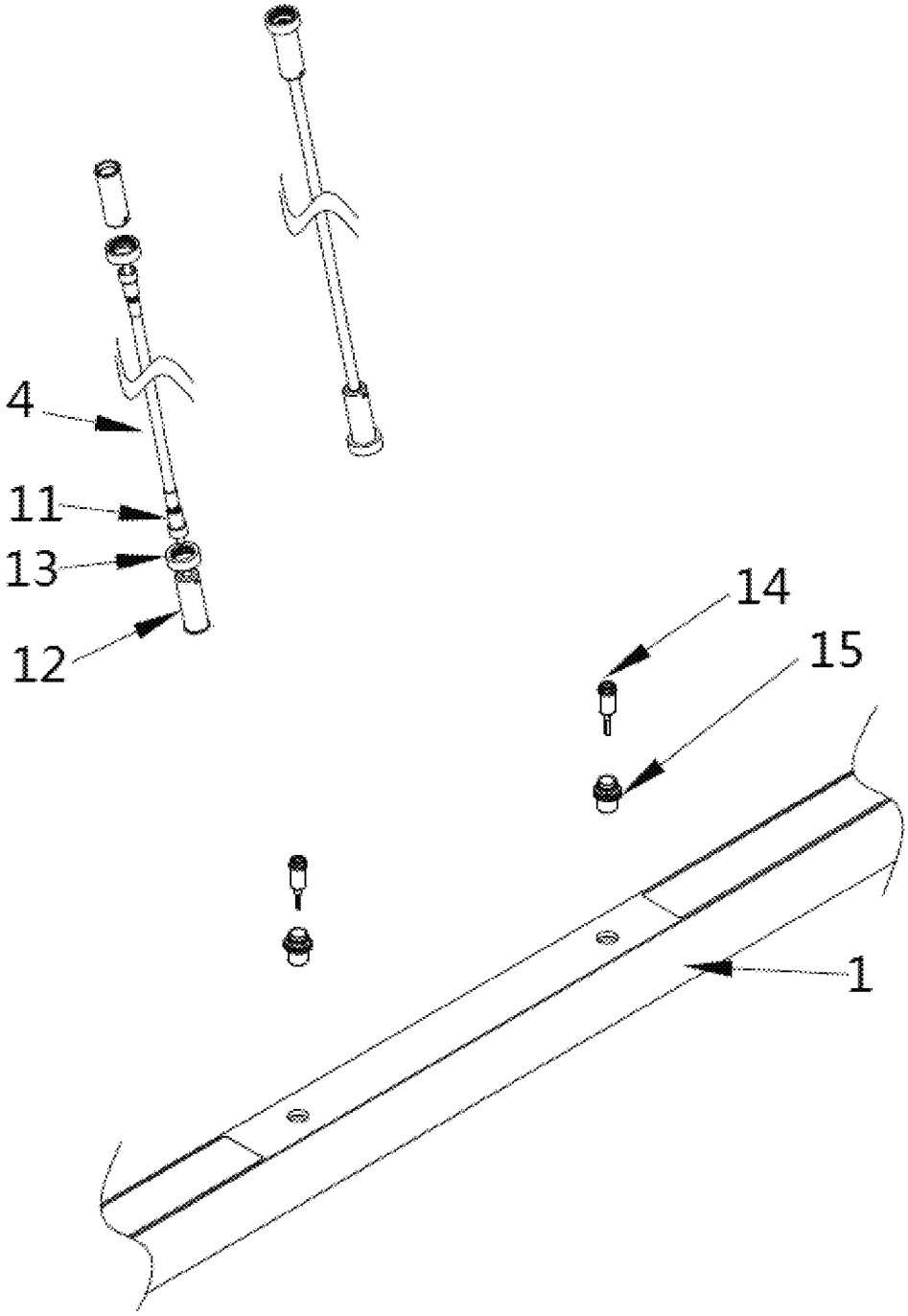
FIG. 4 is an exploded view of a connection structure between the main lighting lamp body and a suspension rod in the example of FIG. 1.

The DC connecting assembly between the suspension connecting portion 4 and the main lighting lamp body 1 is shown in FIG. 4, in which the DC connecting assembly includes a male connector and a female connector. In this example, the female connector is disposed at the main lighting lamp body 1. Which one of the male connector and the female connector is disposed at the main lighting lamp body 1 is not limited in the present disclosure. The female connector includes a DC female terminal 14 and a stud 15. The stud 15 has a hollowed structure, and is sleeved over an external side of the DC female terminal 14. The male connector includes a DC male terminal 11, a male connector housing 12, and an anti-off nut 13. The DC male terminal 11 is disposed in the male connector housing 12, and the anti-off nut 13 is sleeved over an external side of the male connector housing. The plug-in type connection structure of the DC female terminal 14 and the DC male terminal 11 is a rotatable, plug-in type connection structure. The stud 15 and the anti-off nut 13 are engaged with each other in a screw-threaded way. After the DC female terminal 14 and the DC male terminal 11 are connected to each other in a plug-in way to achieve electrical connection, the anti-off nut 13 can be screwed onto the stud 15 to achieve mechanical connection. In other examples, both ends of the suspension connecting portion 4 may be set as male connectors, and the suspension connecting portion 4 and the ceiling box 5 are also connected to each other by the same DC connecting assembly as described above.

In this example, the connection structure between the main lighting lamp body 1 and the first auxiliary lighting lamp body 2, the connection structure between the main lighting lamp body 1 and the second auxiliary lighting lamp body 3, and the connection structure between the main lighting lamp body 1 and the suspension connecting portion 4 all use DC connection assemblies having the same structure, which simplifies the design and allows various types of auxiliary lighting lamp body to be replaced at any time as needed. In this example, each DC connecting assembly is provided with a female connector which is disposed on the main lighting lamp body 1. In other examples, the connectors of the suspension connecting portion 4 and of the auxiliary lighting lamp body that are disposed on the main lighting lamp body 1 may also be different; for example, the connection interface of the main lighting lamp body 1 connected with the suspension connecting portion 4 is the female connector, and the connection interface of the main lighting lamp body 1 connected with the auxiliary lighting lamp body is the male connector, so as to limit the input and output of the electrical connection, without limited in the present disclosure.

The present disclosure provides an integrated lamp that can not only realize main lighting but also realize auxiliary fixed point lighting by flexible assembly.

The technical solution adopted by the present disclosure is to provide an integrated lamp including a main lighting lamp body; the integrated lamp further includes a first auxiliary lighting lamp body which is connected with the main lighting lamp body so as to be assembled on the main lighting lamp body in a plug-in way, and the first auxiliary lighting lamp body is rotatable relative to the main lighting lamp body so as to be adjusted relative to the main lighting lamp body.

Preferably, the integrated lamp further includes a second auxiliary lighting lamp body which is connected with the main lighting lamp body so as to be assembled on the main lighting lamp body in a plug-in way, and the second auxiliary lighting lamp body is rotatable relative to the main lighting lamp body so as to be adjusted relative to the main lighting lamp body.

Preferably, the first auxiliary lighting lamp body and the second auxiliary lighting lamp body are disposed at an upper side and a lower side of the main lighting lamp body, respectively.

Preferably, the main lighting lamp body is an elongate-shaped lamp body, and the first auxiliary lighting lamp body and the second auxiliary lighting lamp body are cylindrical spotlights or strip-shaped spotlights.

Preferably, the main lighting lamp body is electrically and mechanically connected with at least one of the first auxiliary lighting lamp body or the second auxiliary lighting lamp body through a DC connecting assembly, and the main lighting lamp body is configured to supply power to the first auxiliary lighting lamp body and the second auxiliary lighting lamp body through the DC connecting assembly.

Preferably, the integrated lamp further includes a ceiling box and a suspension connecting portion, a driving power supply is disposed in the ceiling box, and both ends of the suspension connecting portion are connected to the ceiling box and the main lighting lamp body, respectively.

Preferably, the suspension connecting portion is a suspension rod or a suspension wire.

Preferably, the main lighting lamp body is electrically and mechanically connected with the suspension connecting portion through a DC connecting assembly, and the ceiling box is configured to supply power to the main lighting lamp body through a wire disposed in the suspension connecting portion and further through the DC connecting assembly.

Preferably, the DC connecting assembly includes a male connector and a female connector that are connectable with each other in a plug-in way, and the male connector or the female connector is disposed on the main lighting lamp body.

Preferably, the female connector includes a DC female terminal and a stud sleeved over an external side of the DC female terminal; the male connector includes a DC male terminal, a male connector housing, and an anti-off nut, the DC male terminal is disposed in the male connector housing, the anti-off nut is sleeved over an external side of the male connector housing, and the stud is engaged with the anti-off nut in a screw-threaded way.

The integrated lamp provided by the present disclosure adopts a DC plug-in connector to realize the quick assembly of the suspension rod, the auxiliary spotlight and the main lamp body; and the number and specification of the auxiliary spotlight can be flexibly selected to meet different requirements for fixed-point lighting. This design greatly reduces the installation difficulty, and can reduce packaging space and transportation cost.

The present disclosure provides a method of manufacturing an integrated lamp. The method may include providing a main lighting lamp body, and connecting a first auxiliary lighting lamp body of the main lighting lamp body with the main lighting lamp body such that the first auxiliary lighting lamp body is assembled on the main lighting lamp body in a plug-in way, where the first auxiliary lighting lamp body is rotatable relative to the main lighting lamp body so as to be adjusted relative to the main lighting lamp body.

The method may also include connecting a second auxiliary lighting lamp body of the main lighting lamp body with the main lighting lamp body such that the second auxiliary lighting lamp body is assembled on the main lighting lamp body in a plug-in way, and where the second auxiliary lighting lamp body is rotatable relative to the main lighting lamp body so as to be adjusted relative to the main lighting lamp body.

The method may include disposing the first auxiliary lighting lamp body and the second auxiliary lighting lamp body at an upper side and a lower side of the main lighting lamp body.

In the method, the main lighting lamp body may be an elongate-shaped lamp body, and the first auxiliary lighting lamp body and the second auxiliary lighting lamp body may be cylindrical spotlights or strip-shaped spotlights.

The method may further include electrically and mechanically connecting the main lighting lamp body with at least one of the first auxiliary lighting lamp body or the second auxiliary lighting lamp body through a DC connecting assembly, and configuring the main lighting lamp body to supply power to the first auxiliary lighting lamp body and the second auxiliary lighting lamp body through the DC connecting assembly.

The method may include providing a ceiling box and a suspension connecting portion for the integrated lamp, and disposing a driving power supply in the ceiling box, and connecting both ends of the suspension connecting portion to the ceiling box and the main lighting lamp body.

In the method, the suspension connecting portion is a suspension rod or a suspension wire.

The method may include electrically and mechanically connecting the main lighting lamp body with the suspension connecting portion through a DC connecting assembly, and configuring the ceiling box to supply power to the main lighting lamp body through a wire disposed in the suspension connecting portion and further through the DC connecting assembly.

The method may also include providing a male connector and a female connector the DC connecting assembly wherein the male connector and the female connector are connectable with each other in a plug-in way, and disposing the male connector or the female connector on the main lighting lamp body.

The method may include providing a DC female terminal and a stud sleeved over an external side of the DC female terminal for the female connector; and providing a DC male terminal, a male connector housing, and an anti-off nut the male connector, disposing the DC male terminal in the male connector housing, sleeving the anti-off nut over an external side of the male connector housing, and engaging the stud with the anti-off nut in a screw-threaded way.

The above description of the examples of the present disclosure is for illustration and description, and is not intended to be exhaustive or limited to the specific form as disclosed.

What is claimed is:

1. An integrated lamp comprising:

a main lighting lamp body, and a first auxiliary lighting lamp body which is connected with the main lighting lamp body so as to be assembled on the main lighting lamp body in a plug-in way, and wherein the first auxiliary lighting lamp body is rotatable relative to the main lighting lamp body so as to be adjusted relative to the main lighting lamp body, and wherein the integrated lamp further comprises a ceiling box and a suspension connecting portion, and wherein a driving power supply is disposed in the ceiling box, and both ends of the suspension connecting portion are connected to the ceiling box and the main lighting lamp body, and the main lighting lamp body is an elongate-shaped lamp body having a main light-emitting surface at a lower side of the main lighting lamp body.

2. The integrated lamp according to claim 1, wherein the integrated lamp further comprises:

a second auxiliary lighting lamp body which is connected with the main lighting lamp body so as to be assembled on the main lighting lamp body in a plug-in way, and wherein the second auxiliary lighting lamp body is rotatable relative to the main lighting lamp body so as to be adjusted relative to the main lighting lamp body.

3. The integrated lamp according to claim 2, wherein the first auxiliary lighting lamp body and the second auxiliary lighting lamp body are disposed at an upper side and a lower side of the main lighting lamp body.

4. The integrated lamp according to claim 2, wherein the first auxiliary lighting lamp body and the second auxiliary lighting lamp body are cylindrical spotlights or strip-shaped spotlights.

5. The integrated lamp according to claim 2, wherein the main lighting lamp body is electrically and mechanically connected with at least one of the first auxiliary lighting lamp body or the second auxiliary lighting lamp body through a DC connecting assembly, and the main lighting lamp body is configured to supply power to the first auxiliary lighting lamp body and the second auxiliary lighting lamp body through the DC connecting assembly.

6. The integrated lamp according to claim 5, wherein the DC connecting assembly comprises a male connector and a female connector that are connectable with each other in a plug-in way, and the male connector or the female connector is disposed on the main lighting lamp body.

7. The integrated lamp according to claim 6, wherein:

the female connector comprises a DC female terminal and a stud sleeved over an external side of the DC female terminal; and the male connector comprises a DC male terminal, a male connector housing, and an anti-off nut, wherein the DC male terminal is disposed in the male connector housing, the anti-off nut is sleeved over an external side of the male connector housing, and the stud is engaged with the anti-off nut in a screw-threaded way.

8. The integrated lamp according to claim 1, wherein the suspension connecting portion is a suspension rod or a suspension wire.

9. The integrated lamp according to claim 1, wherein the main lighting lamp body is electrically and mechanically connected with the suspension connecting portion through a DC connecting assembly, and the ceiling box is configured to supply power to the main lighting lamp body through a wire disposed in the suspension connecting portion and further through the DC connecting assembly.

10. A method of manufacturing an integrated lamp comprising:

providing a main lighting lamp body, connecting a first auxiliary lighting lamp body of the main lighting lamp body with the main lighting lamp body such that the first auxiliary lighting lamp body is assembled on the main lighting lamp body in a plug-in way, wherein the first auxiliary lighting lamp body is rotatable relative to the main lighting lamp body so as to be adjusted relative to the main lighting lamp body, providing a ceiling box and a suspension connecting portion for the integrated lamp, disposing a driving power supply in the ceiling box, and connecting both ends of the suspension connecting portion to the ceiling box and the main lighting lamp body, wherein the main lighting lamp body is an elongate-shaped lamp body having a main light-emitting surface at a lower side of the main lighting lamp body.

11. The method of claim 10, further comprising:

connecting a second auxiliary lighting lamp body of the main lighting lamp body with the main lighting lamp body such that the second auxiliary lighting lamp body is assembled on the main lighting lamp body in a plug-in way, and wherein the second auxiliary lighting lamp body is rotatable relative to the main lighting lamp body so as to be adjusted relative to the main lighting lamp body.

12. The method of claim 11, further comprising:

disposing the first auxiliary lighting lamp body and the second auxiliary lighting lamp body at an upper side and a lower side of the main lighting lamp body.

13. The method of claim 11, wherein the first auxiliary lighting lamp body and the second auxiliary lighting lamp body are cylindrical spotlights or strip-shaped spotlights.

14. The method of claim 11, further comprising:

electrically and mechanically connecting the main lighting lamp body with at least one of the first auxiliary lighting lamp body or the second auxiliary lighting lamp body through a DC connecting assembly, and configuring the main lighting lamp body to supply power to the first auxiliary lighting lamp body and the second auxiliary lighting lamp body through the DC connecting assembly.

15. The method of claim 14, further comprising:

providing a male connector and a female connector the DC connecting assembly wherein the male connector and the female connector are connectable with each other in a plug-in way, and disposing the male connector or the female connector on the main lighting lamp body.

16. The method of claim 15, further comprising:

providing a DC female terminal and a stud sleeved over an external side of the DC female terminal for the female connector; and providing a DC male terminal, a male connector housing, and an anti-off nut the male connector, disposing the DC male terminal in the male connector housing, sleeving the anti-off nut over an external side of the male connector housing, and engaging the stud with the anti-off nut in a screw-threaded way.

17. The method of claim 10, wherein the suspension connecting portion is a suspension rod or a suspension wire.

18. The method of claim 10, further comprising electrically and mechanically connecting the main lighting lamp body with the suspension connecting portion through a DC connecting assembly, and configuring the ceiling box to supply power to the main lighting lamp body through a wire disposed in the suspension connecting portion and further through the DC connecting assembly.

* * * * *